US007677282B2

(12) United States Patent
Stager

(10) Patent No.: US 7,677,282 B2
(45) Date of Patent: Mar. 16, 2010

(54) KNIFE ASSEMBLY AND CHIPPING KNIFE THEREFOR

(75) Inventor: Bradley R. Stager, Beaverton, OR (US)

(73) Assignee: Key Knife, Inc., Tualatin, OR (US)

( * ) Notice: Subject to any disclaimer, the term of this patent is extended or adjusted under 35 U.S.C. 154(b) by 599 days.

(21) Appl. No.: 11/604,181

(22) Filed: Nov. 22, 2006

(65) Prior Publication Data

US 2008/0115858 A1 May 22, 2008

(51) Int. Cl.
*B27C 1/00* (2006.01)

(52) U.S. Cl. ..... 144/241; 144/176; 144/230; 144/235; 144/218; 407/47

(58) Field of Classification Search ..... 144/162.1, 144/172, 174, 176, 218, 220, 235, 241; 241/294, 241/298; 407/40, 42, 47, 107, 111, 113–116
See application file for complete search history.

(56) References Cited

U.S. PATENT DOCUMENTS

| | | | | |
|---|---|---|---|---|
| 3,981,337 | A | 9/1976 | Sundstrom | |
| 4,047,670 | A | 9/1977 | Svennsson | |
| 4,669,516 | A * | 6/1987 | Carpenter et al. | 144/241 |
| 4,754,789 | A * | 7/1988 | Jonsson | 144/241 |
| 5,348,065 | A | 9/1994 | Meyer | |
| 5,649,579 | A | 7/1997 | Kokko et al. | |
| 5,819,826 | A | 10/1998 | Schmatjen | |
| 6,951,313 | B2 | 10/2005 | Frick et al. | |
| 6,968,879 | B2 | 11/2005 | Schuh et al. | |
| RE38,930 | E | 1/2006 | Swartwood et al. | |
| 7,069,969 | B2 | 7/2006 | Knappett | |
| 7,140,408 | B1 * | 11/2006 | Hinchliff et al. | 144/241 |
| 7,159,626 | B2 * | 1/2007 | Biller et al. | 144/176 |
| 2003/0019543 | A1 | 1/2003 | Schuh | |
| 2003/0131907 | A1 | 7/2003 | Biller et al. | |

FOREIGN PATENT DOCUMENTS

| | | |
|---|---|---|
| CA | 2491977 | 7/2006 |
| CH | 658424 | 11/1986 |
| CH | 687 182 | 10/1996 |
| DE | 2645804 | 4/1978 |
| DE | 9108553 | 9/1991 |
| DE | 19837029 | 2/2000 |
| EP | 1 329 295 | 7/2003 |
| WO | PCT/US2007/000312 | 6/2007 |
| WO | PCT/US2007/001860 | 6/2007 |

* cited by examiner

*Primary Examiner*—Shelley Self
(74) *Attorney, Agent, or Firm*—Portland Intellectual Property, LLC

(57) ABSTRACT

A knife assembly and chipping knife therefor. The knife is rotated about an axis and has a front side facing the direction of rotation. The knife has a single deflector ridge extending from the front side of the knife and two indexing features on either side of the deflector ridge, each corresponding to spaced apart, parallel cutting edges of the knife defining a plane.

36 Claims, 9 Drawing Sheets

KNIFE ASSEMBLY AND CHIPPING KNIFE THEREFOR

FIELD OF THE INVENTION

The present invention relates to a knife assembly and chipping knife therefor, which is primarily used for cutting chips or flakes from logs.

BACKGROUND

In the use of cutting apparatus for processing logs to usable lumber, the log is forced into contact with a rotating cutting head of the apparatus that typically carries a plurality of removably clamped, elongate knives. The cutting head to which the knives are clamped typically falls into one of three classes of head shape, known in the art as disc, drum, and conical.

The apparatus spins at a relatively high rate compared to the rate of feed of the log, so that a single encounter between one of the knives of the apparatus and the log results in the displacement and removal of a relatively small portion of the log. With variations resulting from the variations in the rate of rotation relative to the rate of feed, the head geometry and the shape and configuration of the knives, this small portion is what is generally referred to in the art as a "chip" or a "flake" (hereinafter "chip") of more or less controlled dimensions. The chip often has commercial value in itself and is not simply waste material, as it can be used in the production of manufactured wood products such as oriented strand board.

Typically, the cutting head rotates at thousands of revolutions per minute, so each chip is removed quickly, resulting in large forces being applied to the knives. To maintain chip quality, it is important to maintain the position of the knives against these forces. So the prior art has provided numerous knife shapes, typically defined in cross-sections perpendicular to the elongate axes of the knives, that work in cooperation with the clamping members to help secure the knives. For use in disc style cutting heads, the knives are often double-sided, providing two parallel cutting edges on either side of the knife. This allows turning the knife to expose a fresh cutting edge when the exposed cutting edge becomes worn.

Schmatjen, U.S. Pat. No. 5,819,826, assigned to Key Knife, Inc. of Tualatin, Oreg., describes a double-sided knife having what have often been referred to as a pair of "deflector ridges" on the side of the knife that faces in the direction of rotation of the cutting head. The deflector ridges project from this side of the knife and therebetween form, essentially, a keyway or channel that indexes the knife to a suitably shaped inner clamping member that receives the bottom side of the knife. This indexing is an example of shaping the knife in cooperation with the clamping members to stabilize the position of the knife in the apparatus, and it also provides for easy installation of the knife into proper position.

Outer, curved transition portions of the deflector ridges further provide for guiding the flow of chips cut from the knife away from the cutting edge in such manner as to avoid damaging the chips as well as to efficiently "exhaust" the chips from the apparatus so that the required flow of material past the cutting edge is facilitated or at least not impeded.

The knife of the '826 Patent has a plane of symmetry (lying mid-way between the deflector ridges) such that the knife may be turned end-for-end to expose the alternate cutting edge.

Frick et al., U.S. Pat. No. 6,951,313 shows a double-sided knife having two spaced-apart projections, where one of the projections extends from the side of the knife that faces toward the direction of rotation of the cutting head, and the other extends from the side of the knife that faces away from this direction. It can be roughly compared in general configuration, for present illustrative purpose, to the knife of the '826 Patent, cut along its plane of symmetry into two facing halves, where one of the halves is flipped 180 degrees. Thus, to expose the alternate cutting edge, the knife of the '313 Patent is turned 180 degrees about its elongate axis instead of end-for-end. Aside from this difference, the configuration provides no apparent purpose, and it has the disadvantage that one of the projections is always non-functional and therefore is simply dead weight.

While a number of different knife configurations have been proposed, that of the '826 Patent has been at least one of the most commercially successful because it provides a number of operational and manufacturing advantages. However, there remains a need for a knife assembly and chipping knife therefore providing for further improvements over the prior art.

SUMMARY

A knife assembly and chipping knife therefor. A knife assembly includes a knife, and employs an upper clamping member and a lower clamping member for clamping the knife therebetween.

The knife has an elongate axis and two spaced apart cutting edges parallel to the elongate axis. The cutting edges define a reference plane. The knife is further defined by a plane of reflective symmetry that is perpendicular to the reference plane and which contains the elongate axis.

The knife has a front side and a back side spaced from the front side. The front and back sides terminate in the cutting edges. The front and back sides define a positive direction, perpendicular to the reference plane, running from the back side toward the front side. A deflector ridge projects from the front side and reaches a first point of greatest maximum projection of the knife in the positive direction, the point lying in the plane of reflective symmetry. Two substantially identical indexing features of the front side are disposed on either side of the deflector ridge and correspond, respectively, to the two cutting edges. Each indexing feature has a second point of minimum projection of the front side in the positive direction and a third point projecting further in the positive direction than the second point but less than the first point. The first, second, and third points all lie on a plane that is perpendicular to both the reference plane and the plane of reflective symmetry. The third point is disposed farther from the plane of reflective symmetry than the second point.

In use, one of the aforedescribed indexing features of the front side of the knife, and to some extent the deflector ridge itself, provides for indexing the knife to the lower clamping member of the knife assembly.

The back side of the knife may also have one or more indexing features for indexing the knife to the upper clamping member of the knife assembly. Particularly, the knife may have either (a) a recess, or (b) a projection, for this purpose, providing for double-indexing the knife to the knife assembly.

As another alternative, a top-most portion of the back side of the knife may be substantially planar, which is particularly advantageous when using the knife in a simplified cutting apparatus in which double-indexing of the knife is not desired. In one such apparatus, the knife assembly may further include a base, or holder, having two opposite sides to which, respectively, the upper and lower clamping members are adapted to be removably mounted.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Reference will now be made in detail to specific preferred embodiments of the invention, examples of which are illustrated in the accompanying drawings.

For purposes herein, chips, flakes, and other such terms used to describe portions of logs or lumber removed by cutting apparatus as have been described above are intended to fall within the meaning of the term "chips," where the cutting that produces these portions is referred to as "chipping," with no loss of generality intended. Thus, it is to be understood that knives according to the invention may be used, with suitable modification, in, e.g., chipper or chipping discs, waferizers, drum chippers or flakers, ring slicers, conical chippers or canters, and any similar cutting apparatus used in the wood processing industry. Further, such knives may be used in chipping apparatus adapted for chipping materials other than wood.

Figure 1:
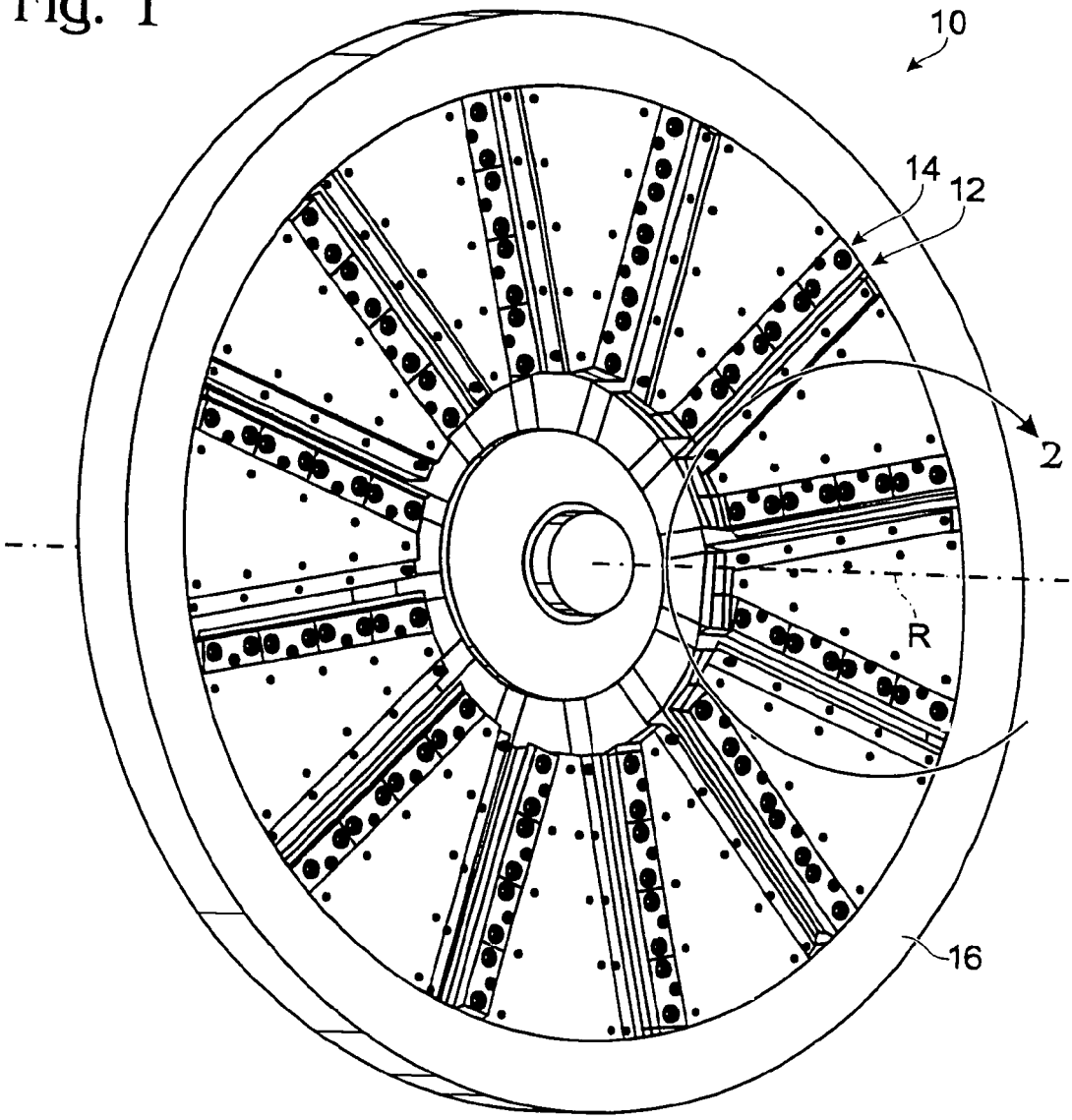
FIG. 1 is a side elevation of a chipper disc incorporating a plurality of knives according to the present invention.
Figure 2:
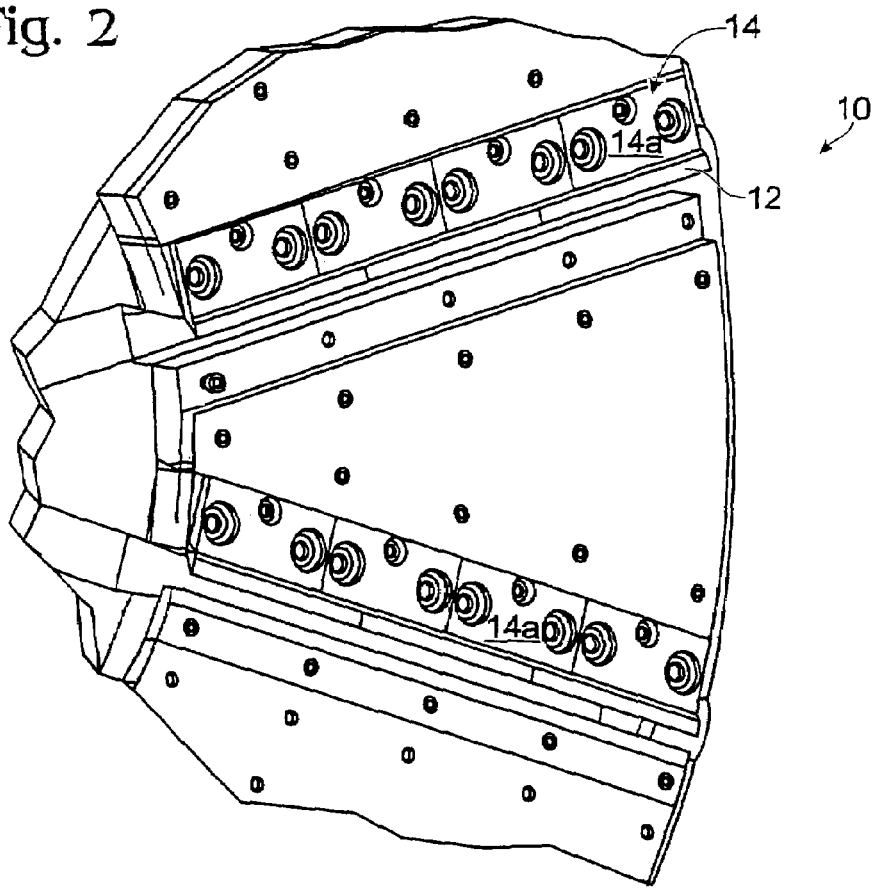
FIG. 2 is the detail circle referenced in FIG. 1, above, as 2-2.

As an exemplary context for use of chipping knives according to the invention, FIGS. 1 and 2 show a disc chipper 10. On the side of the chipper 10 are a plurality of chipping knives 12 and associated clamps 14 for removably clamping the knives 12 to a cutting head 16 of the chipper 10. The cutting head 16 rotates about an axis of rotation "R," causing each knife 12 to sweep out an annular space.

Figure 3:
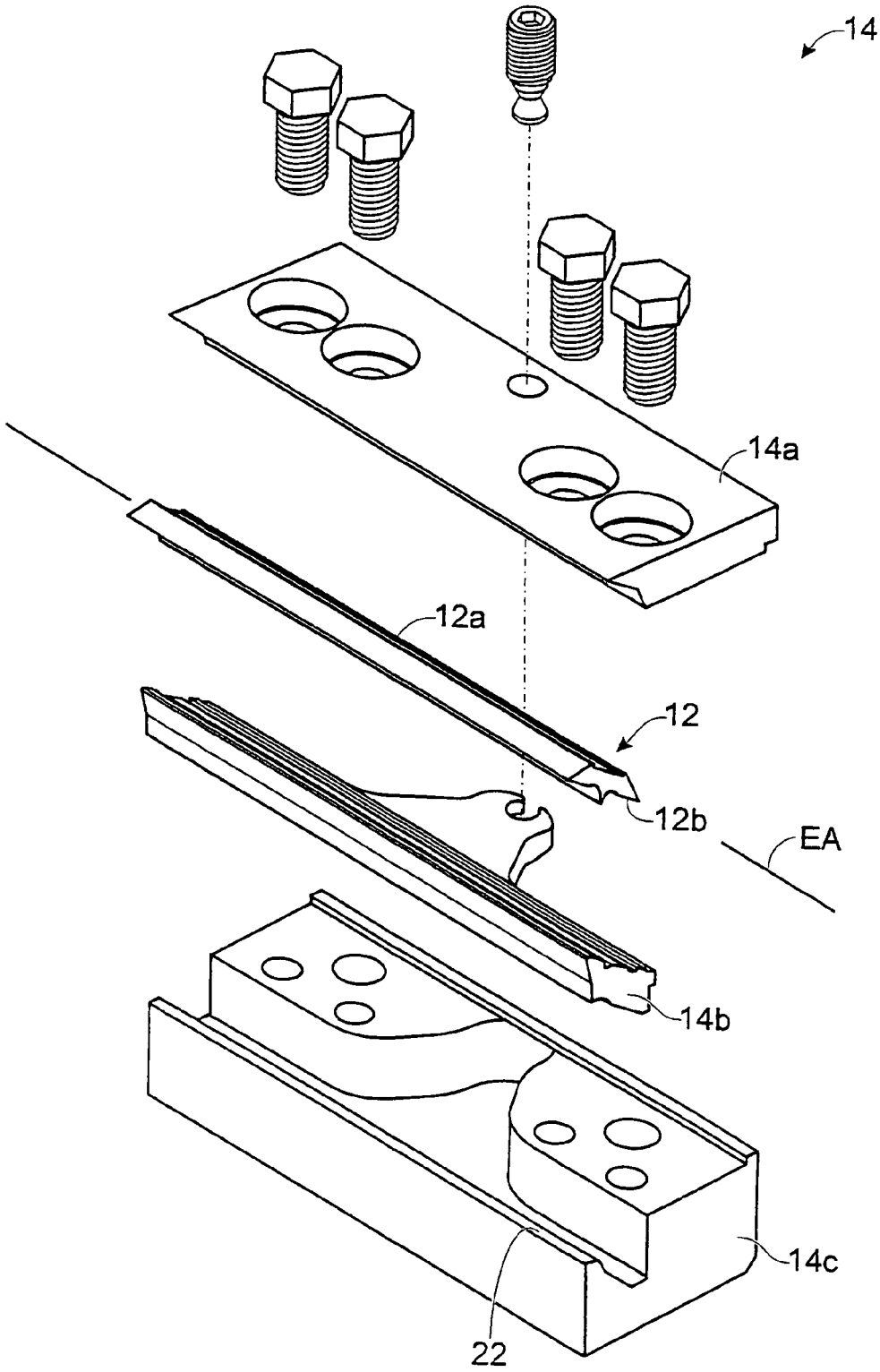
FIG. 3 is an exploded pictorial view of a preferred clamp for clamping one of the knives of the chipper disc of FIG. 1.

As best seen in FIG. 3, showing an exploded view of the clamps 14, the clamps 14 typically include an upper clamping member 14*a* and a lower clamping member 14*b*, the latter often referred to in the art as a "counterknife." The upper and lower clamping members receive respective back and front sides 12*a*, 12*b* of the associated knife 12.

FIG. 3 shows a preferred embodiment for clamping the knives 12 in which each clamp 14 includes a base 14*c* which is bolted to the cutting head 16, and the lower clamping member 14*b* is disposed between the base and the upper clamping member 14*a*. Further, preferably, the lower clamping member 14*b* is adapted for pivotal adjustment about a pivot 22 of the base 14*c*.

Figure 4:
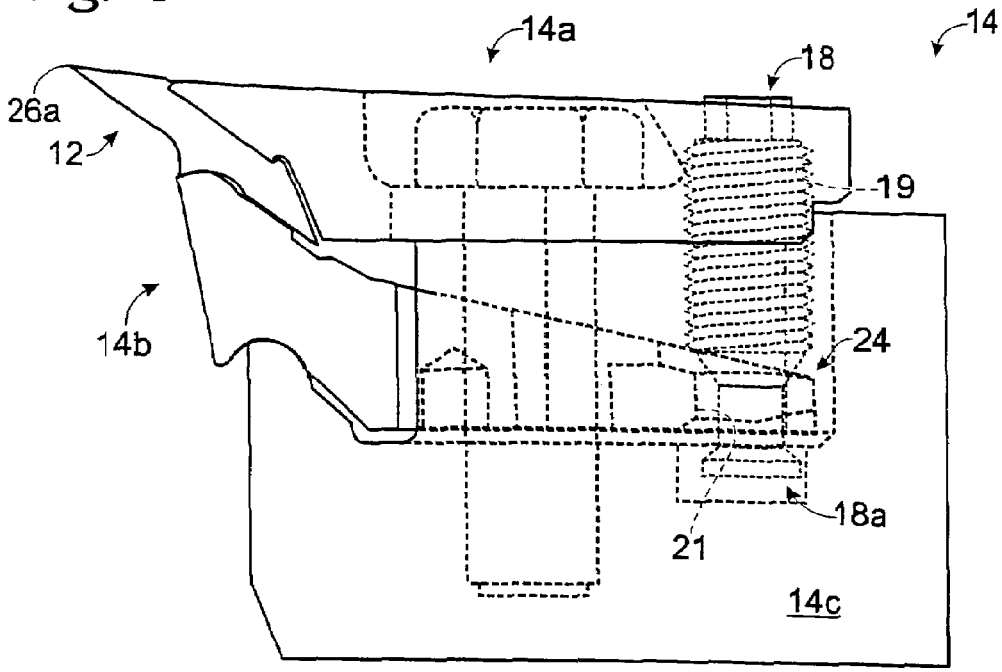
FIG. 4 is a side elevation of the clamp of FIG. 3, showing a lower clamping member, a knife, and an upper clamping member, with the lower clamping member pivoted away from the upper clamping member.
Figure 5:
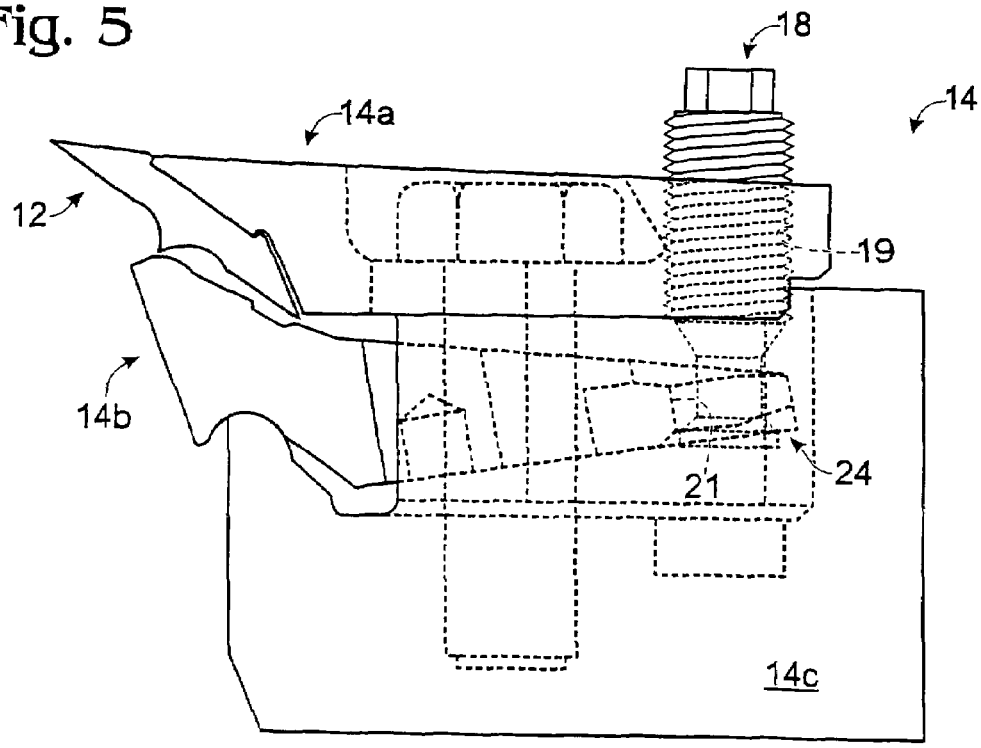
FIG. 5 is a side elevation of the clamp of FIG. 4, showing the lower clamping member pivoted toward the upper clamping member, for clamping the knife between the two clamping members.

The action can be seen by comparing FIGS. 4 and 5. An adjustment bolt 18 is threadingly received in a through-hole 19 of the upper clamping member 14*a*, and an end 18*a* of the bolt is captured in a through-hole 21 of an end 24 of the lower clamping member 14*b*. The lower clamping member 14*b* is supported by the bolt 18 at the end 24, and by the base 14*c* at the pivot 22.

Turning the bolt 18 raises or lowers the bolt with respect to the upper clamping member 14*a*, taking the end 24 of the lower clamping member with it. The lower clamping member 14*b* thus pivots about the pivot 22 with movement of the bolt 18.

In FIG. 3, an elongate configuration of the knife 12 can be seen, the knife therefore having an elongate axis "EA." FIGS. 4 and 5 view the knife 12 in a direction parallel to the axis EA.

In FIG. 4, the knife 12 is clamped between the upper and lower clamping members 14*a*, 14*b*. In FIG. 5, the lower clamping member 14*b* has been pivoted about the pivot point 22 so as to drop the knife 12 down and away from the upper clamping member. The knife is no longer clamped, and is easily accessible and held in a convenient position for removal.

While providing the aforedescribed pivoting function is preferred, it is not essential for use of the knife 12.

Figure 8:
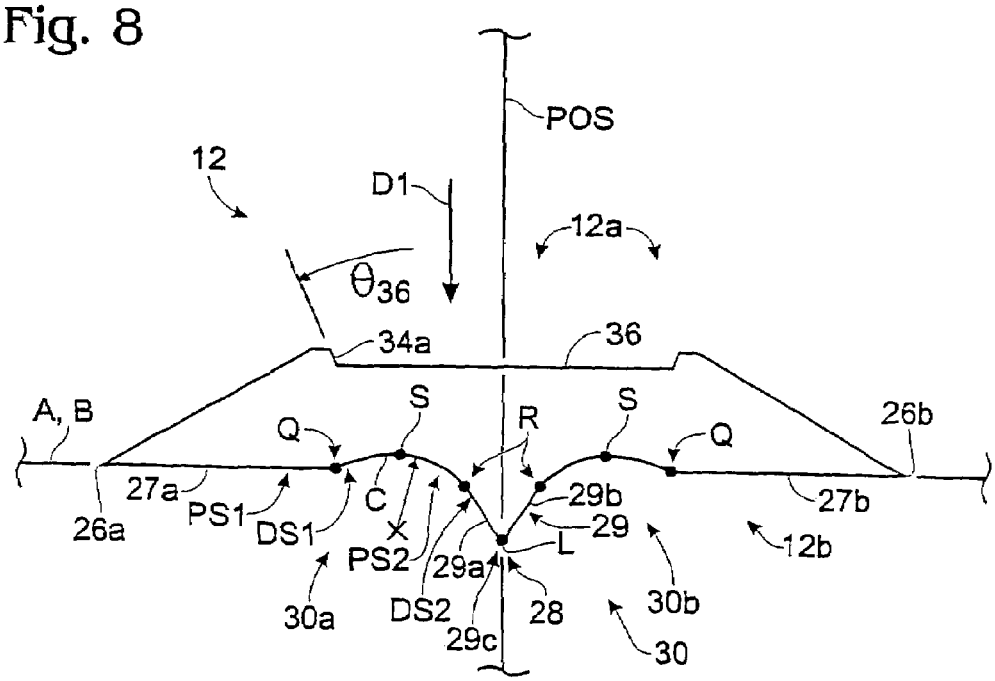
FIG. 8 is an end view of the knife of FIGS. 6 and 7.
Figure 6:
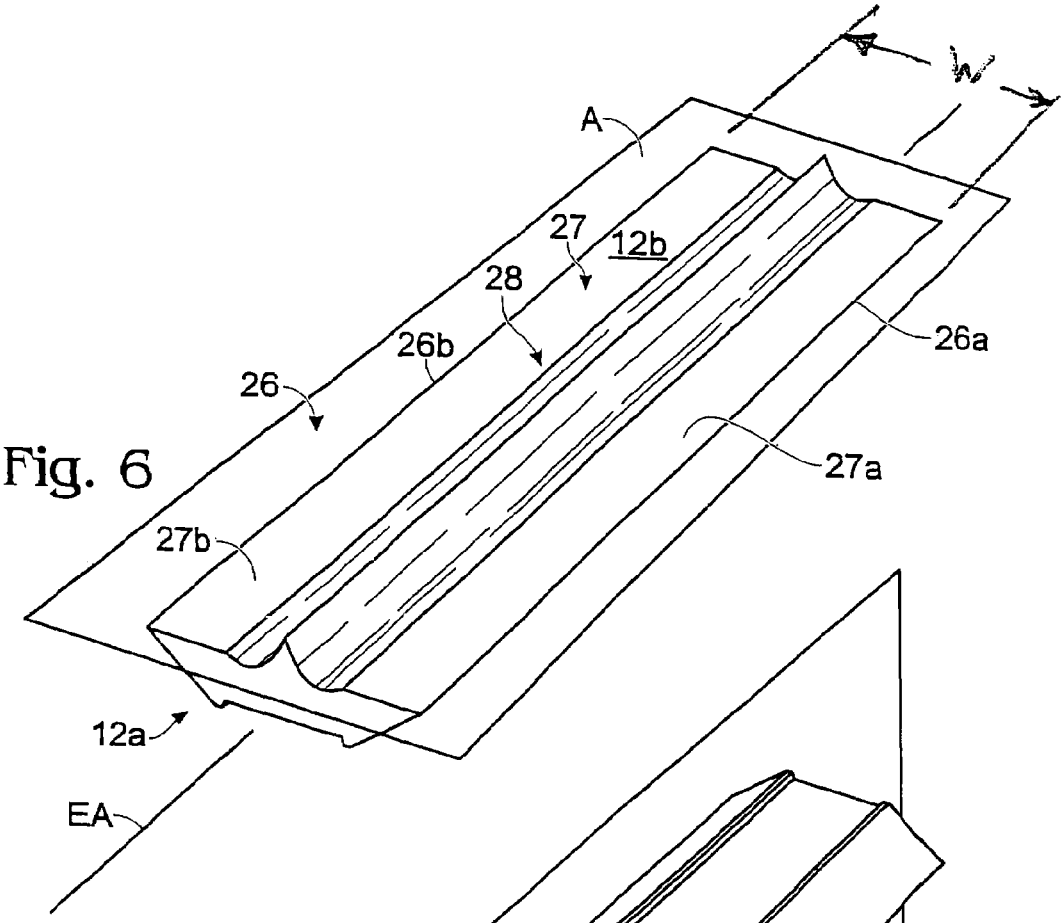
FIG. 6 is a back-side isometric view of the knife of FIGS. 4 and 5.
Figure 7:
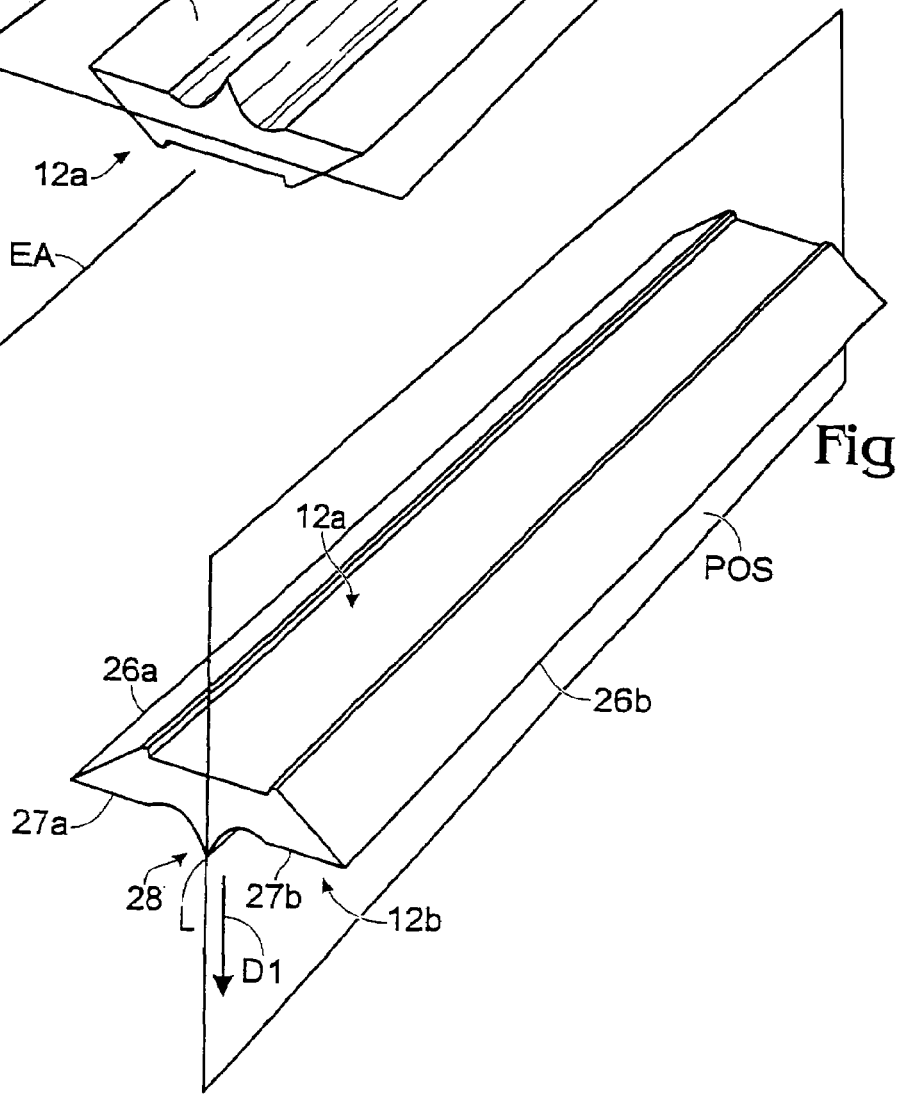
FIG. 7 is a front-side isometric view of the knife of FIG. 6.

The knife 12 is shown in perspective in FIGS. 6 and 7, and in end view in FIG. 8. The knife has a back side 12*a* and a front side 12*b*. As will be understood by persons of ordinary skill, the front side 12*b* faces the direction of rotation of the cutting head, and for purposes herein, a vector pointing from the back side toward the front side will be considered to point in a "positive" direction.

As shown, the knife has two parallel cutting edges 26 lying in a reference plane "A," the edges referenced as 26*a* and 26*b*. The front side 12*b* includes two substantially planar knife-edge-joining portions 27, namely 27*a* and 27*b* that may also lie in the plane A, but which may be disposed at non-zero angles with respect to the plane A if desired. For example, even if the knife-edge-joining portions are originally provided to lie in the plane A, these surfaces may be ground as known in the art to alter the attack angle of the knife 12.

Between the knife-edge-joining portions 27, and projecting from the front side 12*b* of the knife 12, is a single deflector ridge 28. The deflector ridge 28 reaches a linear edge or line of points "L" of greatest maximum projection of the knife in the positive direction "D1" indicated by the arrow (FIG. 7), from the plane A, the line lying in a plane of reflective symmetry "POS" of the knife. The plane of reflective symmetry is perpendicular to the plane A and parallel to the elongate axis EA of the knife. With this symmetry, the knife 12 can be removed from the apparatus when it is in the configuration shown in FIG. 5, turned end-for-end to provide a fresh cutting edge, and reinstalled.

With particular reference to FIG. 8, the deflector ridge 28 has two canted outer surfaces 29, namely 29*a* and 29*b*, joining at an apex that is preferably sharp, but which in typical practice is slightly rounded-off, and where the amount of such rounding is not particularly important. The outer surfaces 29 may be substantially planar as shown, or may be concave and, preferably, smoothly curving.

The deflector ridge 28 provides, in the outer surfaces 29, a guiding surface for efficiently guiding cut chips away from the apparatus. This guiding action also protects the lower clamping member 14*b* from wear as a result of preventing contact with the chips that would otherwise occur. Further, a single deflector ridge may be made larger than the corresponding deflector ridges of a pair without any additional metal being required. This provides for a stronger deflector ridge that is also more capable of providing the aforedescribed functions with no increase in the weight of the knife 12. It also provides for a stronger knife by distributing more metal farther from the neutral axis, as in an I-beam.

Figure 9:
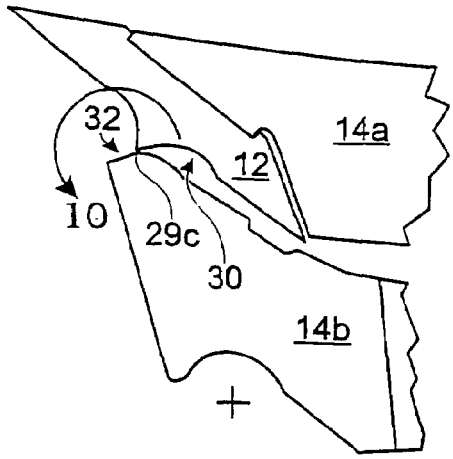
FIG. 9 is a side elevation of the clamp of FIG. 4, showing the lower clamping member pivoted to a position of close proximity to the knife.

With particular reference to FIG. 8, preferably, the front side 12*b* of the knife 12 also includes a pair of indexing features 30, namely 30*a* and 30*b*, as will be described. The indexing features 30 help, along with the deflector ridge 28, to index the knife to the lower clamping member 12*b*. With reference to FIG. 9, the indexing features 30 of the knife cooperate with a complementary indexing feature 32 of the lower clamping member, and the features 30 and 32 may be provided with many alternative complementary shapes and dispositions to serve the purpose of providing for knife indexing. However, preferably, the indexing features 30 and 32 have specific shapes and dispositions for serving additional purposes as described below.

Turning back to FIG. 8, each indexing feature 30 is disposed between the corresponding knife-edge-joining portion 27*a*, 27*b* and the deflector ridge 28. That is, distal sides "DS1" of the indexing features 30 merge with proximal sides "PS1" of the knife-edge-joining portions 27 at points "Q," and proximal sides "PS2" of the indexing features 30 merge with distal sides "DS2" of the outer surfaces 29 of the deflector ridge 28 at points "R."

Due to the symmetry of the knife, the points Q on both sides of the plane of symmetry POS define a plane "B," which in this example is coincident with the plane A but need not be as mentioned above. The orientation of the knife shown in FIG. 8 is a drawing convention in which the front side of the knife is at the bottom of the Figure, so that the positive direction "D1" is downward. The indexing features describe re-entrant contours "C" that intersect the plane B at points Q, and points "S" on these contours are points of minimum projection of the front side 12*b* of the knife with respect to the positive direction D1.

This re-entrant disposition of the indexing features 30 provides the advantage of tucking the features up and out of the way of chip flow so that, as the knife-edge-joining portions wear, the indexing features remain in substantially un-worn condition.

Further, each contour C is preferably shaped as a concave, smoothly varying arc, most preferably circular, that smoothly merges with the corresponding outer surface 29*a*, 29*b* of the deflector ridge 28. In correspondence, the complementary feature 32 of the lower clamping member 12*b* is a mating or complementary convex, smoothly varying arc, such as shown in FIG. 9. The purpose served by this particular combination of shapes can be seen by reference to FIGS. 9, 11, and 13 showing, in degrees, the lower clamping member 14*b* being pivoted up into position against the knife 12, to clamp the knife.

Figure 10:
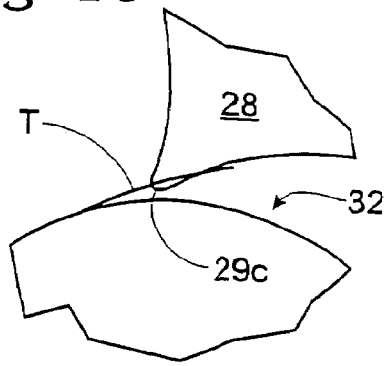
FIG. 10 is a detail circle referenced as 10-10 in FIG. 9.

In FIG. 9, the lower clamping member 14*b* is being pivoted upwardly, toward the knife 12, and is about to make first contact with the knife, particularly at the apex 29*c* of the deflector ridge 28. FIG. 10 shows the detail circle indicated in FIG. 9. In FIG. 10, a trace "T" is shown of the path of the indexing feature 32 as a result of further upward pivoting of the lower clamping member 14*b*. The trace T foretells an interference that will occur, but has not yet occurred, between the feature 32 and the corresponding indexing feature 30.

Figure 11:
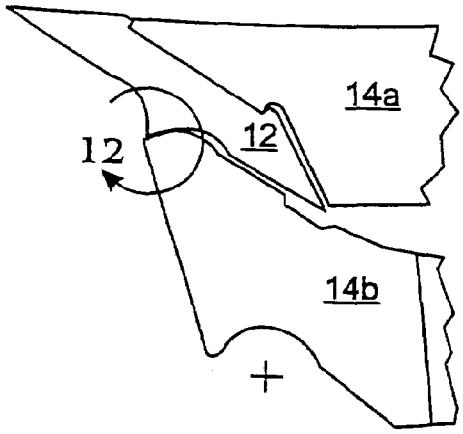
FIG. 11 is a side elevation of the clamp of FIG. 4, showing the lower clamping member pivoted into a position of interference with the knife.
Figure 12:
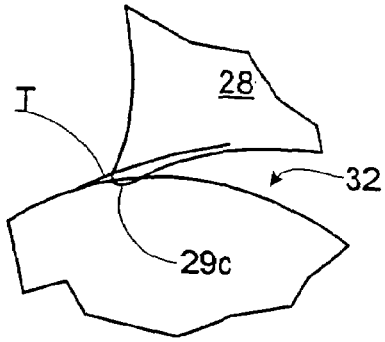
FIG. 12 is a detail circle referenced as 12-12 in FIG. 11.

FIGS. 11 and 12, corresponding to FIGS. 9 and 10 respectively, show this interference more explicitly, by showing the relative positions of these features in the case that further upward pivoting of the lower clamping member 14*b* toward the knife 12 has occurred. The interference is shown by an overlapping of the indexing features 30 and 32 that, as will be readily appreciated, cannot physically occur.

Figure 13:
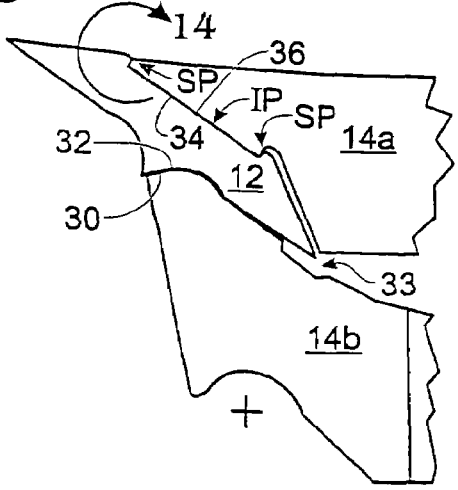
FIG. 13 is a side elevation of the clamp of FIG. 4, showing the lower clamping member pivoted as in FIG. 5, resolving the interference of FIG. 11.

FIG. 13 shows the final progression of pivoting of the lower clamping member 14*b* into position against the knife, for clamping the knife in place. For the indexing features 30 and 32 to reach the relative positions shown in FIG. 13 from those shown in FIG. 11, the knife must first yield the small amount necessary to accommodate the interference shown in FIGS. 11 and 12. Such yielding occurs for two reasons. First, there is some compliance in the deflector ridge 28. Second, there is a slight readjustment of the contact that the back side 12*a* of the knife makes with the upper clamping member 14*a* as the knife settles into a stable position.

The capability for readjustment of the contact between the back side 12*a* of the knife and the upper clamping member 14*a* depends on the geometry of these parts. Preferably, with reference to FIG. 13 for example, the upper clamping member 14*a* includes a projection 34 that is shaped to fit a recess 36 in the back side 12*a* of the knife 12, to index the knife to the upper clamping member, though the shapes of these features could be reversed, i.e., the projection 34 could be replaced with a recess where the recess 36 is replaced with a corresponding projection.

Figure 14:
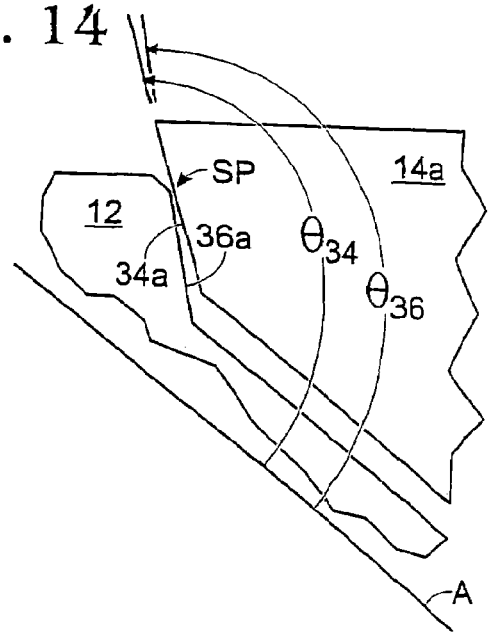
FIG. 14 is the detail circle referenced as 14-14 in FIG. 13.

FIG. 14 shows the detail circle indicated in FIG. 13. Preferably, the projection 34 and the recess 36 have complementary canted sides 34*a*, 36*a* that describe respective obtuse angles θ, namely $\theta_{34}$, $\theta_{36}$, relative to the aforedescribed plane A, where $\theta_{34}>\theta_{36}$. This relationship between the angles θ ensures that contact will be made at widely spaced apart points "SP" rather than intermediate points such as the point "IP." It may also be appreciated that this manner of providing interfering contact between the projection 34 and the recess 36 allows for some movement of the knife (a combination of linear movement parallel to the plane A and 20 rotation) and, such as described above, before the knife settles into its final stable position as shown in FIG. 13.

The position of the knife 12 relative to the lower clamping member 14*b* as shown in FIG. 13 is stable because the apex 29*c* of the deflector ridge 28 has traveled "over center" with respect to, or "cammed over" the indexing feature 32 of the lower clamping member. The smoothly varying contour C is preferably and most simply a circular arc as indicated in FIG. 8, though a cam-over function could be provided by use of a curved shape that is not circular. It is has been determined that in the system as shown the knife 12 can be felt to "snap" into stable position, providing a reliable tactile indication that the knife has been successfully indexed into proper position.

Figure 15:
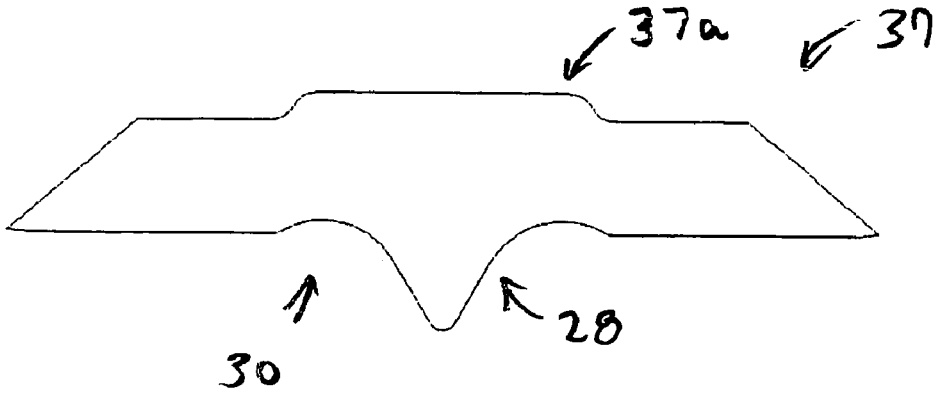
FIG. 15 is a side elevation of an alternative knife according to the present invention, having a projection on the back side of the knife.
Figure 16:
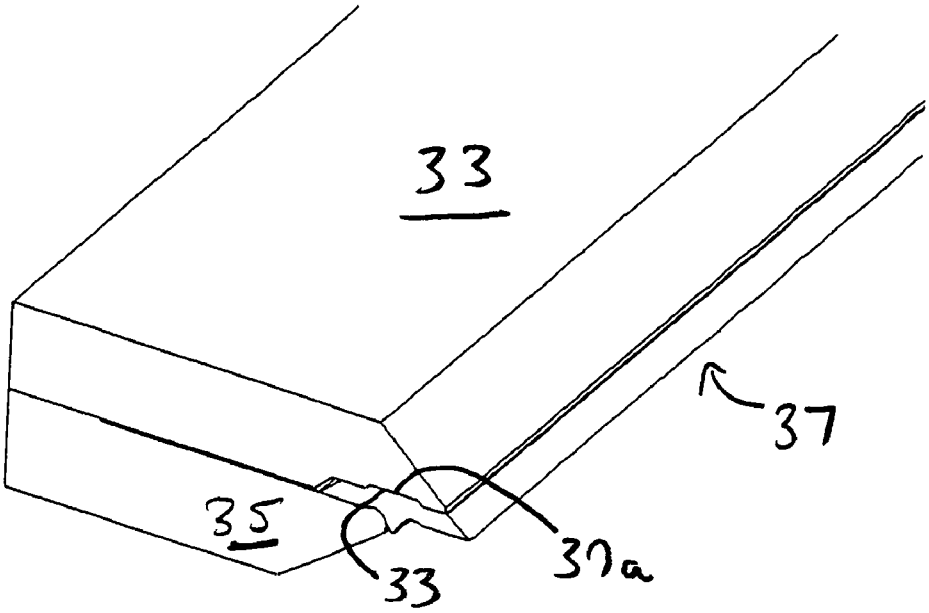
FIG. 16 is a top-side isometric view of the knife of FIG. 15 clamped between upper and lower clamping members according to the present invention.

As mentioned, the back side of the knife may have either a recess or a projection for indexing the knife to the upper clamping member. Shown was the knife 12 having a recess. FIGS. 15 and 16 show a knife 37 with a projection 37*a*; all other aspects of the knife 37 being as described for the knife 12. With particular reference to FIG. 16, the knife 37 is clamped between an upper clamping member 33 and a lower clamping member 35. The projection 37*a* mates with a corresponding recess 33*a* in the upper clamping member.

All else being equal, the recess provides for a stronger upper clamping member but a weaker knife, and the projection provides for the reverse. Strengthening the upper clamping member to compensate for weakness introduced by the provision of a recess therein is often not difficult, or otherwise does not impose an unacceptable penalty, so the projection may be preferred in some circumstances. In addition, the projection may be preferred where it is desired to perform automatic knife changing as known in the art.

One of the indexing features of the front of the knife, and to some extent the deflector ridge itself, indexes the knife to the lower clamping member, and the recess or projection indexes the knife to the upper clamping member. While the particular forms of indexing provided herein are novel, some form of "double-indexing" of a knife to the cutting apparatus to which it is clamped is typical.

As the knife wears, it is important to be able to adjust the position of the knife in the apparatus to preserve the relationship between the cutting edge and the log or other material being cut. Where the knife is double-indexed, both clamping members are constrained to move with the knife, and some additional structure to which both clamping members are mounted must be able to move to perform this adjustment.

In a preferred ring slicer produced by the assignee of the present application, it was desired to simplify the structural elements used to clamp and carry the knife, and it is recognized that this same objective may be important or desired in any other type of cutting apparatus, for cutting wood or any other material. In that case, it is advantageous to omit the indexing to the upper clamping member, so that the knife can move relative to the upper clamping member, to make the aforementioned adjustment of knife position.

Figure 17:
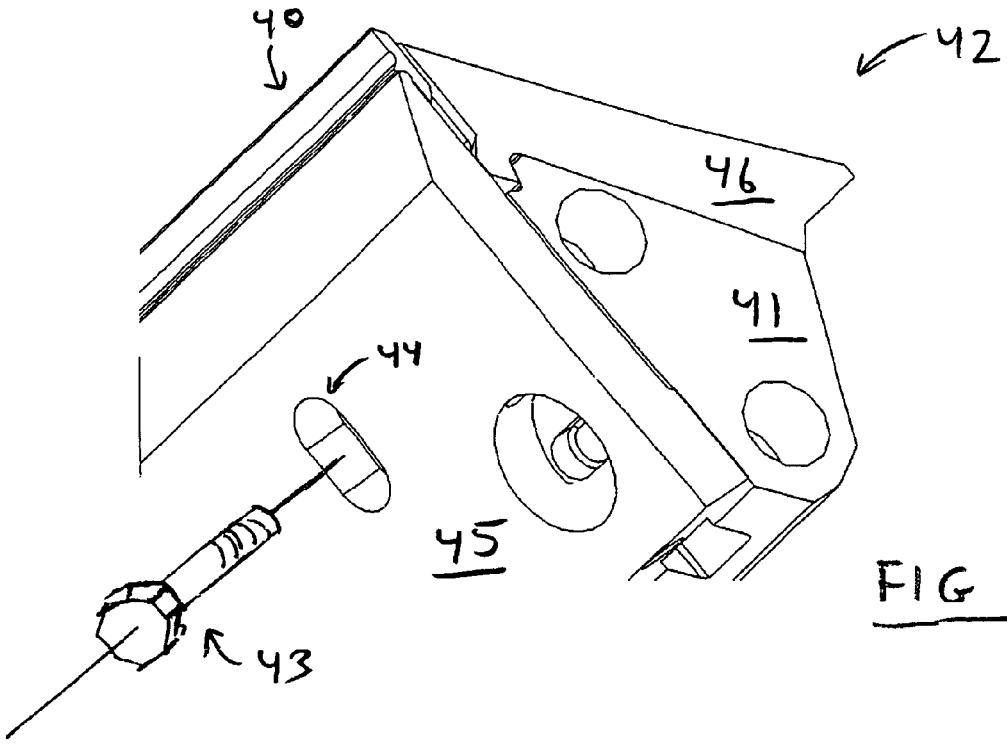
FIG. 17 is a bottom-side isometric view of a knife assembly according to the present invention in a ring slicer, showing another alternative knife according to the present invention clamped between upper and lower clamping members that are mounted to an intermediating base.
Figure 18:
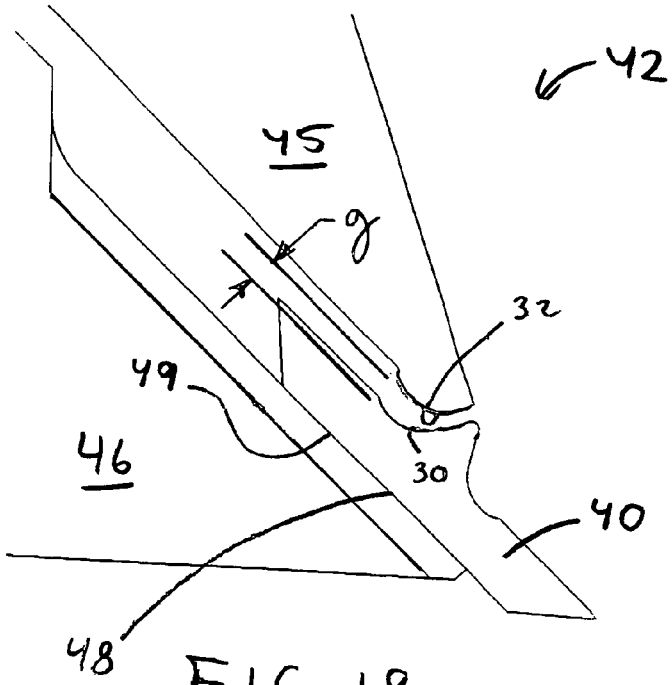
FIG. 18 is a side elevation of the knife assembly of FIG. 17, particularly showing a wearshoe, a lower clamping member, and the knife in greater detail.

Providing for this, FIG. 17 shows a knife 40 according to the invention clamped in a knife assembly 42 for installation in a ring slicer. Clamping bolts 43 extend through elongate holes 44 in the lower clamping member 45. The upper clamping member 46 in this example is a "wearshoe," which is a term of art in ring slicers. FIG. 18 shows a detail of the knife as it is captured between the wearshoe and the lower clamping member. The orientation shown in FIG. 18 is a drawing convention, even though the upper clamping member 46 is shown on the bottom of the Figure.

Referring back to FIG. 17, the knife assembly 42 includes a base, or holder, 41. The wearshoe is bolted to one side of the base and the lower clamping member is bolted to an opposite side of the base.

Figure 19:
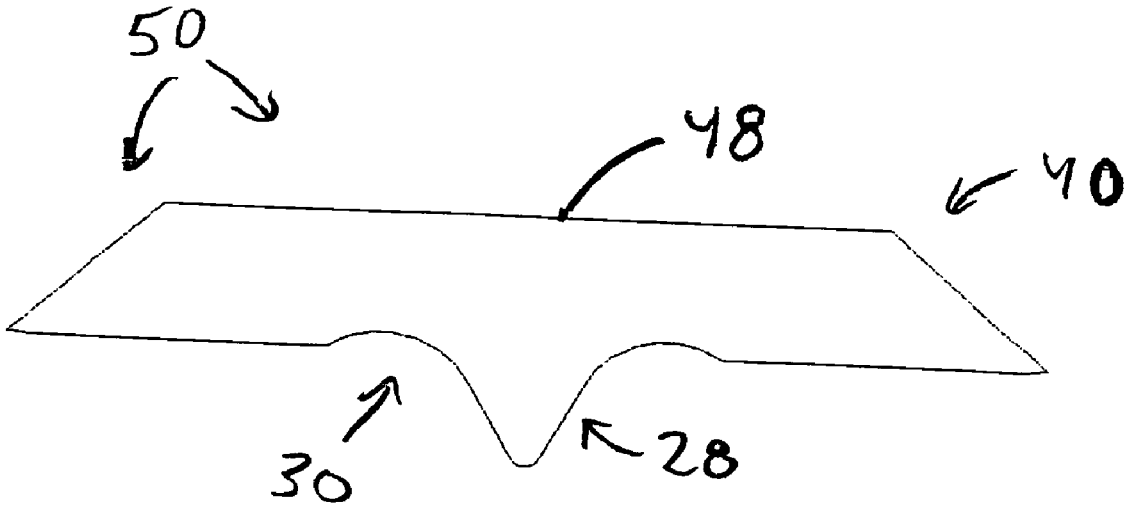
FIG. 19 is a side elevation of the knife of FIGS. 17 and 18.

FIG. 19 shows the knife 40 in cross-section, for comparison with the knife 12 of FIG. 8 and the knife 37 of FIG. 15. It can be seen that the knife 40 differs from these in that the recess or projection is omitted, and it has instead a substantially planar top-most ("top") portion 48 of the back side 50 of the knife. All other aspects of the knife 40 are the same as those described above in connection with the knife 12.

Returning to FIG. 18, there is shown a gap "g" in FIG. 18 between the lower clamping member 45 and the knife 40, particularly the indexing features 32 and 30, respectively. In the preferred ring slicer, this gap is closed, i.e., the indexing features 32 and 30 are brought together and the knife becomes clamped, by elastic deflection of the lower clamping member 45, caused by tightening the bolts 43. Relaxation of the lower clamping member, by loosening the bolts 43, allows for easy removal of the knife from the knife assembly. This feature, while preferred, is not essential to the present invention.

Returning to FIG. 17, the top portion 48 is in contact with the wearshoe 46. The lower clamping member 45 can be moved in the directions indicated by the double-headed arrow, relative to the clamping bolt 43, this movement being permitted by the elongate shape of the hole 44 and the substantially planar surface of the top portion 48 which allows the knife to slide on the wearshoe rather than indexing the knife to the wearshoe.

Among the advantages of the single deflector ridge 28, it allows the knife to be shorted in width "W" (see FIG. 6) as compared to knives having dual ridges as in the prior art. This permits the use of less material, resulting in smaller size and lower cost, making it more economical to purchase and store the knife as well as making it more practical to simply dispose of the knife rather than repair it. Another advantage is that the material used to form two ridges can now be combined into a single ridge, making the single ridge stronger for the same total amount of material used.

Referring back to FIG. 8, as mentioned, the contours C provide points S of minimum projection in the direction D1. In applications in which it is desirable to provide the substantially planer top portion 48, such as in a ring slicer, it is preferable that the aforedescribed planes A and B be coincident, and that the points S and L be disposed on opposite sides of these planes.

It is to be understood that, while a specific knife assembly and chipping knife therefor has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A knife having an elongate axis and two spaced apart cutting edges parallel to said elongate axis, said cutting edges defining a reference plane, the knife further defined by a plane of reflective symmetry that is perpendicular to said reference plane and which contains said elongate axis, the knife having a front side and a back side spaced from said front side, said front and back sides terminating in said cutting edges, said front and back sides defining a positive direction, perpendicular to said reference plane, running from said back side toward said front side, a deflector ridge projecting from said front side and reaching a first point of greatest maximum projection of the knife in said positive direction, said point lying in said plane of reflective symmetry, and two substantially identical indexing features of said front side disposed on either side of said deflector ridge and corresponding, respectively, to said two cutting edges, each said indexing feature having a second point of minimum projection of said front side in said positive direction and a third point projecting further in said positive direction than said second point but less than said first point, said first, second and third points all lying in a plane that is perpendicular to both said reference plane and said plane of reflective symmetry, said third point being disposed farther from said plane of reflective symmetry than said second point, said back side being substantially planar.

2. The knife of claim 1, wherein said first and second points lie on opposite sides of said reference plane.

3. The knife of claim 1, wherein said indexing features define substantially circular arcs.

4. The knife of claim 3, said front side further including two substantially planar knife-edge-joining portions, each knife-edge-joining portion terminating in one of said cutting edges and the third point of the corresponding indexing feature.

5. The knife of claim 4, wherein said knife-edge-joining portions are substantially co-planar.

6. The knife of claim 5, wherein said knife-edge-joining portions lie substantially in said reference plane.

7. The knife of claim 6, wherein said first and second points lie on opposite sides of said reference plane.

8. The knife of claim 1, said front side further including two substantially planar knife-edge-joining portions, each knife-edge-joining portion terminating in one of said cutting edges and the third point of the corresponding indexing feature.

9. The knife of claim 8, wherein said knife-edge-joining portions are substantially co-planar.

10. The knife of claim 9, wherein said knife-edge-joining portions lie substantially in said reference plane.

11. The knife of claim 10, wherein said first and second points lie on opposite sides of said reference plane.

12. The knife of claim 2, wherein said indexing features define substantially circular arcs.

13. A knife assembly, comprising:

an upper clamping member adapted to receive said back side of the knife;

a lower clamping member adapted to receive said front side of the knife, said upper and lower clamping members for clamping the knife therebetween; and a knife having an elongate axis and two spaced apart cutting edges parallel to said elongate axis, said cutting edges defining a reference plane, the knife further defined by a plane of reflective symmetry that is perpendicular to said reference plane and which contains said elongate axis, the knife having a front side and a back side spaced from said front side, said front and back sides terminating in said cutting edges, said front and back sides defining a positive direction, perpendicular to said reference plane, running from said back side toward said front side, a deflector ridge projecting from said front side and reaching a first point of greatest maximum projection of the knife in said positive direction, said point lying in said plane of reflective symmetry, and two substantially identical indexing features of said front side disposed on either side of said deflector ridge and corresponding, respectively, to said two cutting edges, each said indexing feature having a second point of minimum projection of said front side in said positive direction and a third point projecting further in said positive direction than said second point but less than said first point, said first, second and third points all lying in a plane that is perpendicular to both said reference plane and said plane of reflective symmetry, said third point being disposed farther from said plane of reflective symmetry than said second point, said back side being substantially planar.

14. The knife of claim 13, wherein said first and second points lie on opposite sides of said reference plane.

15. The knife of claim 13, wherein said indexing features define substantially circular arcs.

16. The knife of claim 15, said front side further including two substantially planar knife-edge-joining portions, each knife-edge-joining portion terminating in one of said cutting edges and the third point of the corresponding indexing feature.

17. The knife of claim 16, wherein said knife-edge-joining portions are substantially co-planar.

18. The knife of claim 17, wherein said knife-edge-joining portions lie substantially in said reference plane.

19. The knife of claim 18, wherein said first and second points lie on opposite sides of said reference plane.

20. The knife of claim 13, said front side further including two substantially planar knife-edge-joining portions, each knife-edge-joining portion terminating in one of said cutting edges and the third point of the corresponding indexing feature.

21. The knife of claim 20, wherein said knife-edge-joining portions are substantially co-planar.

22. The knife of claim 21, wherein said knife-edge-joining portions lie substantially in said reference plane.

23. The knife of claim 22, wherein said first and second points lie on opposite sides of said reference plane.

24. The knife of claim 14, wherein said indexing features define substantially circular arcs.

25. The knife assembly of claim 13, wherein said lower clamping member is a wearshoe, the knife assembly further comprising a base, said wearshoe adapted for mounting engagement with said base on one side of said base and said upper clamping member for mounting engagement with an opposite side of said base.

26. The knife of claim 25, wherein said first and second points lie on opposite sides of said reference plane.

27. The knife of claim 25, wherein said indexing features define substantially circular arcs.

28. The knife of claim 27, said front side further including two substantially planar knife-edge-joining portions, each knife-edge-joining portion terminating in one of said cutting edges and the third point of the corresponding indexing feature.

29. The knife of claim 28, wherein said knife-edge-joining portions are substantially co-planar.

30. The knife of claim 29, wherein said knife-edge-joining portions lie substantially in said reference plane.

31. The knife of claim 30, wherein said first and second points lie on opposite sides of said reference plane.

32. The knife of claim 25, said front side further including two substantially planar knife-edge-joining portions, each knife-edge-joining portion terminating in one of said cutting edges and the third point of the corresponding indexing feature.

33. The knife of claim 32, wherein said knife-edge-joining portions are substantially co-planar.

34. The knife of claim 33, wherein said knife-edge-joining portions lie substantially in said reference plane.

35. The knife of claim 34, wherein said first and second points lie on opposite sides of said reference plane.

36. The knife of claim 26, wherein said indexing features define substantially circular arcs.

* * * * *